US008421623B2

(12) United States Patent
Rosenberg

(10) Patent No.: US 8,421,623 B2
(45) Date of Patent: Apr. 16, 2013

(54) INFECTIOUS DISEASE WARNING SYSTEM

(76) Inventor: Mitchell Chester Rosenberg, Cherry Hill, NJ (US)

( * ) Notice: Subject to any disclaimer, the term of this patent is extended or adjusted under 35 U.S.C. 154(b) by 231 days.

(21) Appl. No.: 12/907,125

(22) Filed: Oct. 19, 2010

(65) Prior Publication Data

US 2012/0092162 A1 Apr. 19, 2012

(51) Int. Cl.
*G08B 21/22* (2006.01)
*G08B 21/24* (2006.01)

(52) U.S. Cl.
USPC ..... 340/541; 340/532; 340/692; 704/274

(58) Field of Classification Search ..... 704/274–275, 704/E13.008; 389/88.01; 340/516–517, 340/521–522, 528, 532, 540, 541, 545.1–545.2, 340/691.1–692
See application file for complete search history.

(56) References Cited

U.S. PATENT DOCUMENTS

| | | | | |
|---|---|---|---|---|
| 5,074,894 | A | 12/1991 | Nelson | |
| 5,471,198 | A | 11/1995 | Newham | |
| 5,532,680 | A * | 7/1996 | Ousborne | 340/567 |
| 5,808,553 | A | 9/1998 | Cunningham | |
| 6,148,297 | A * | 11/2000 | Swor et al. | 1/1 |
| 6,158,613 | A * | 12/2000 | Novosel et al. | 221/3 |
| 6,323,773 | B1 * | 11/2001 | Runyon et al. | 340/573.1 |
| 7,994,900 | B1 * | 8/2011 | Langstroth et al. | 340/286.07 |
| 2001/0045037 | A1 * | 11/2001 | Bank et al. | 40/621 |
| 2002/0050006 | A1 | 5/2002 | Saraya | |
| 2003/0107493 | A1 * | 6/2003 | Recko et al. | 340/692 |
| 2004/0262377 | A1 * | 12/2004 | Matz | 235/375 |
| 2006/0049936 | A1 * | 3/2006 | Collins et al. | 340/539.11 |
| 2006/0197656 | A1 * | 9/2006 | Sergio et al. | 340/539.11 |
| 2007/0252720 | A1 * | 11/2007 | Hughes et al. | 340/691.3 |
| 2008/0033256 | A1 * | 2/2008 | Farhan et al. | 600/300 |
| 2008/0184719 | A1 * | 8/2008 | Lowenstein | 62/127 |
| 2009/0051545 | A1 | 2/2009 | Koblasz | |
| 2009/0066486 | A1 * | 3/2009 | Kiekbusch et al. | 340/286.02 |
| 2010/0073169 | A1 * | 3/2010 | Needham et al. | 340/573.1 |
| 2010/0134296 | A1 | 6/2010 | Hwang | |
| 2010/0169111 | A1 * | 7/2010 | Brue et al. | 705/2 |
| 2010/0265086 | A1 * | 10/2010 | Olson et al. | 340/691.6 |
| 2011/0208541 | A1 * | 8/2011 | Wilson et al. | 705/3 |
| 2012/0095779 | A1 * | 4/2012 | Wengrovitz et al. | 705/3 |

OTHER PUBLICATIONS

Notification of Transmittal of the International Search Report and the Written Opinion of the International Searching Authority, or the Declaration issued by dated Apr. 10, 2012.

Dr. Jeff Topal; "Contact precautions specifications" YNHH Infection Control Manual; http://www.med.yale.edu/ynhh/infection/contact/specification.html; Jun. 22, 2010.

* cited by examiner

*Primary Examiner* — Benjamin C Lee
*Assistant Examiner* — Stephen Burgdorf
(74) *Attorney, Agent, or Firm* — Michael B. Fein; Eckert Seamans Cherin & Mellott, LLC

(57) ABSTRACT

A system comprising a portable unit which can be temporarily placed outside a patient room comprising a processor, memory, a speaker or voice generator, and programming to allow an authorized user to select (A) a disease or medical condition which corresponds to preprogrammed simulated voice warnings, for example "wash hands," "wear gown," "wear gloves," "wear mask," "dispose of gown," "use hand sanitizer," "wash hands with soap and water after removing protective clothing," and combinations of said voice warnings; or (B) one or more of said preprogrammed voice warnings; a room entry detector programmed to activate the simulated voice warnings, the system configured so that when entry to the room is detected, one or a combination of the simulated voice warnings is emitted by the system.

8 Claims, 4 Drawing Sheets

INFECTIOUS DISEASE WARNING SYSTEM

BACKGROUND OF THE INVENTION

The present invention relates to the field of medical devices, more particularly to the field of contact isolation and infectious disease warning systems.

More than 90,000 Americans get life-threatening, invasive infections annually from the drug-resistant *Staphylococcus* "superbug", Methicillin-resistant *Staphylococcus aureus* (MRSA), often in an institutional setting such as a hospital; these infections reach the bloodstream or destroy flesh and turn deadly. MRSA-related hospitalizations have increased by as much as 119% over three years according to some reports. Death rates average 1,000 per month. *Clostridium difficile* (*C. diff*) which is a highly contagious bacterium causing diarrhea, colitis, toxic megacolon, and colonic perforations can also be spread in hospital settings via fecal contamination of objects and surfaces. Death rates from this have been increasing dramatically in recent years as well. The fact that these and other organisms have mutated to become highly resistant to antibiotics makes them difficult to eradicate and thus a major initiative has been placed on preventing their spread. The mainstay of prevention is hygiene and contact isolation.

Other infectious agents are transmitted via airborne or droplet vectors and specific strategies are utilized to prevent their spread. At times, the hospital must arrange protective isolation for immuno-compromised patients.

Hospital patient rooms are generally open to visitors, medical and paramedical staff, and hospital employees, but when medically compromised patients occupy a hospital room, special precautions, following certain protocols which depend on the patient condition, must be taken to prevent transmitting disease to the patient or from the patient.

Warning visitors and staff of the precautions which must be taken regarding an individual patient under isolation has been a problem for hospitals. Due to the fact that hospitals are very busy places with many types of passive signs and other devices used for many purposes, it is not a rare occurrence for handwritten or even printed signs to be ignored or accidentally overlooked. Furthermore, placement of the sign can be ambiguous if the doors or entryways are adjacent with little space between them A better, more active, yet inexpensive, solution to this problem is needed and it is an object of the present invention to provide a device and a corresponding method to address this problem.

SUMMARY OF THE INVENTION

This object, and others which will become apparent from the following disclosure and accompanying drawings, are achieved by the present invention which comprises in one aspect a system comprising a processor, memory, a speaker or voice generator, and a set of programming instructions functioning to allow an authorized user to select (A) a disease, medical condition, or type of isolation which corresponds to preprogrammed simulated voice warnings; or (B) one or more preprogrammed voice warnings; a room entry detector programmed to activate the simulated voice warnings, the system configured so that when entry of the room is detected one or a combination of either (A) the one or more simulated voice warnings corresponding to the selected disease, medical condition, or type of isolation, or (B) the one or more selected voice warnings, is emitted by the system.

Examples of voice warnings are "wash hands," "wear gown," "wear gloves," "wear mask," "dispose of gown," "use hand sanitizer," "wash hands with soap and water after removing protective clothing," and combinations of said voice warnings. Examples of additional voice warnings which can be programmed into the system are listed in Table 1.

In another aspect, the invention comprises a method of warning visitors and medical staff of a patient condition in a patient room comprising placing such a system outside the patient room and selecting a disease or medical condition of the patient, type of isolation, or one or more specific voice warnings. The system is programmed so that when a person is detected entering the patient room, one or a combination of the voice warnings is emitted by the voice generator or speaker. The particular voice warnings emitted by the voice generator or speaker are those which are preprogrammed to be emitted when a particular disease or medical condition of the patient or type of isolation is selected, or are one or more of a plurality of voice options which can be selected directly by an authorized user, for example a nurse.

The system can comprise a portable unit which can be temporarily placed outside a patient room, for example on a door, door jamb, or wall near the entrance to the room.

The invention is an improvement over existing systems since it is much more unlikely that a visitor to a room housing a patient with a contagious medical condition, or a immune-depressed medical condition, will unwittingly enter the room without proper precautions if the visitor is warned by an alarm system which emits voice warnings, especially if the voice warning is from a preprogrammed selectable set. Sophisticated airplane cockpit systems have in recent years included voice warnings, especially those simulating a female voice, for important events since it has been discovered that when pilots are very busy and in a rush, like hospital staff, they notice a female voice warning more readily than other types of alarms.

BRIEF DESCRIPTION OF THE DRAWINGS

The description set forth above, as well as other objects, features and advantages of the present invention, will be more fully appreciated by referring to the detailed description and the drawings that follow.

DETAILED DESCRIPTION OF THE PREFERRED EMBODIMENTS OF THE INVENTION

Figure 1:
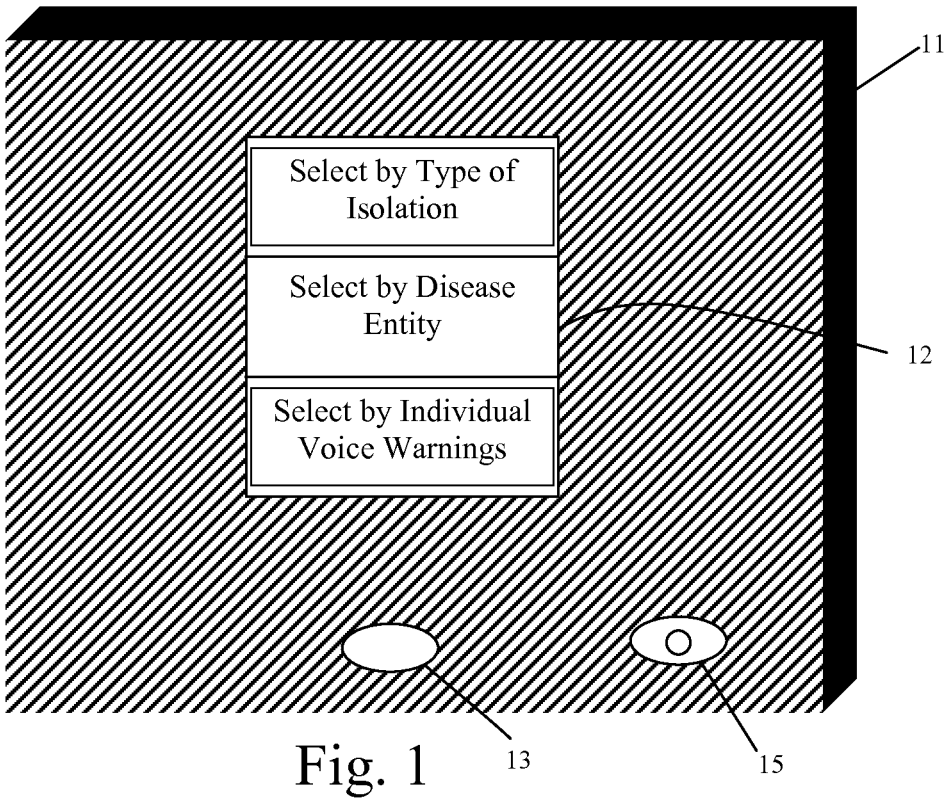
FIG. 1 is a front perspective view of device according to the invention, showing a touch screen with a welcome message and a speaker.

Reference is now made generally to FIG. 1 wherein one embodiment of a system according to the invention wherein a box 11 having a touch screen 12 which displays a welcome screen having three selection modes, "select by disease entity," "select by type of isolation," and "select by individual voice warnings." The box 11 includes a processor and memory, and a sound generator which is capable of generating voice simulations, and a speaker 13 as well as the touch screen 12. The box also includes a motion detector or proximity detector 15. The motion or proximity detector can be adjusted with respect to sensitivity and other factors using the touch screen in setting mode, for example. The motion detector can be a smart detector so that it can distinguish between irrelevant events such as a person passing by a room and an actual person entering the patient room.

Figure 2:
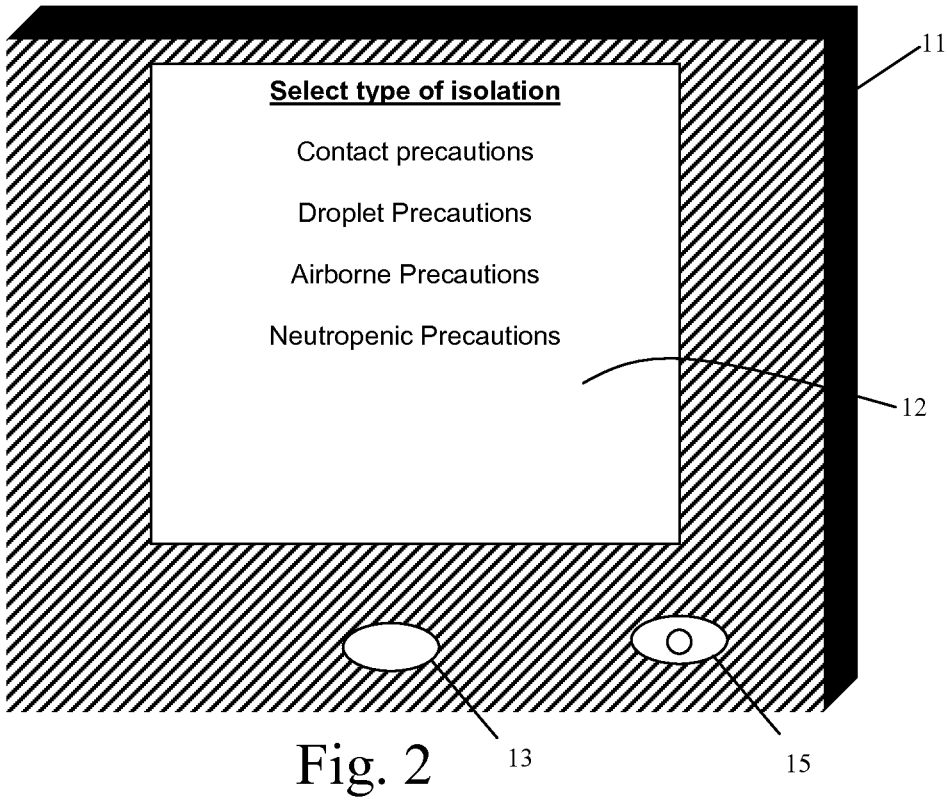
FIG. 2 is a front perspective view of device according to the invention, showing a touch screen displaying a selectable list of types of precautions, and a speaker.

FIG. 2 illustrates the same device as the display would appear when Select by Type of Isolation is selected on the welcome screen.

Figure 3:
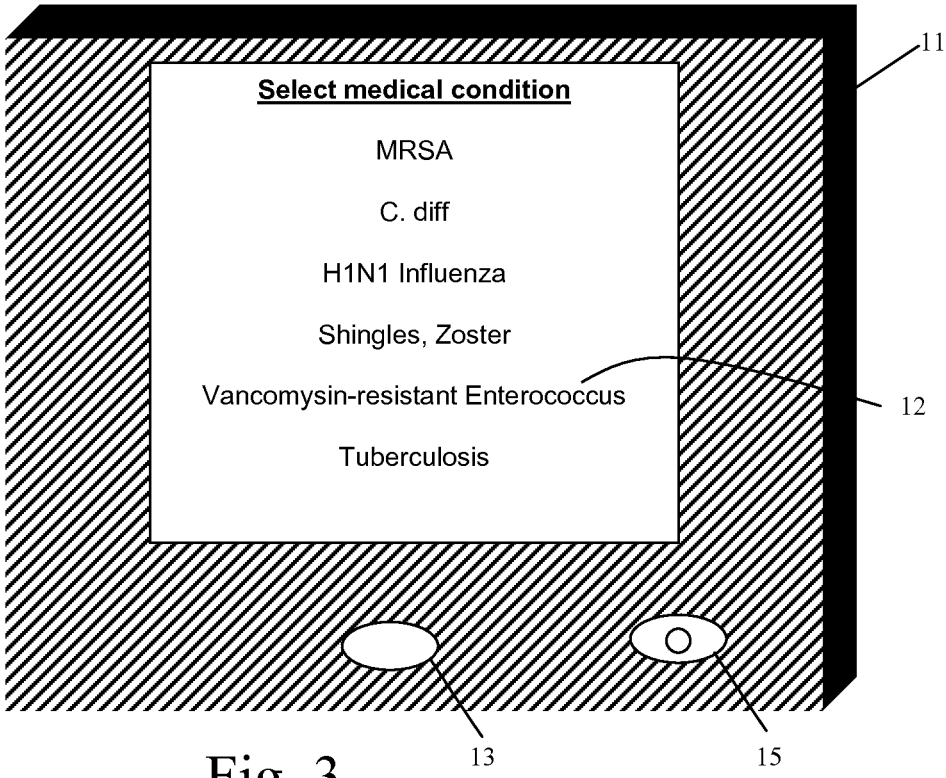
FIG. 3 is a front perspective view of device according to the invention, showing a touch screen displaying a selectable list of medical conditions, and a speaker.

FIG. 3 illustrates the device of FIG. 1 as the display would appear when the Select by Medical Condition is touched on the welcome screen. An example of a set of voice warnings in one embodiment of the device include: "wash hands," "wear gown," "wear gloves," "wear mask," "dispose of gown," "use hand sanitizer," "wash hands with soap and water after removing protective clothing," and combinations of said voice warnings.

Figure 4:
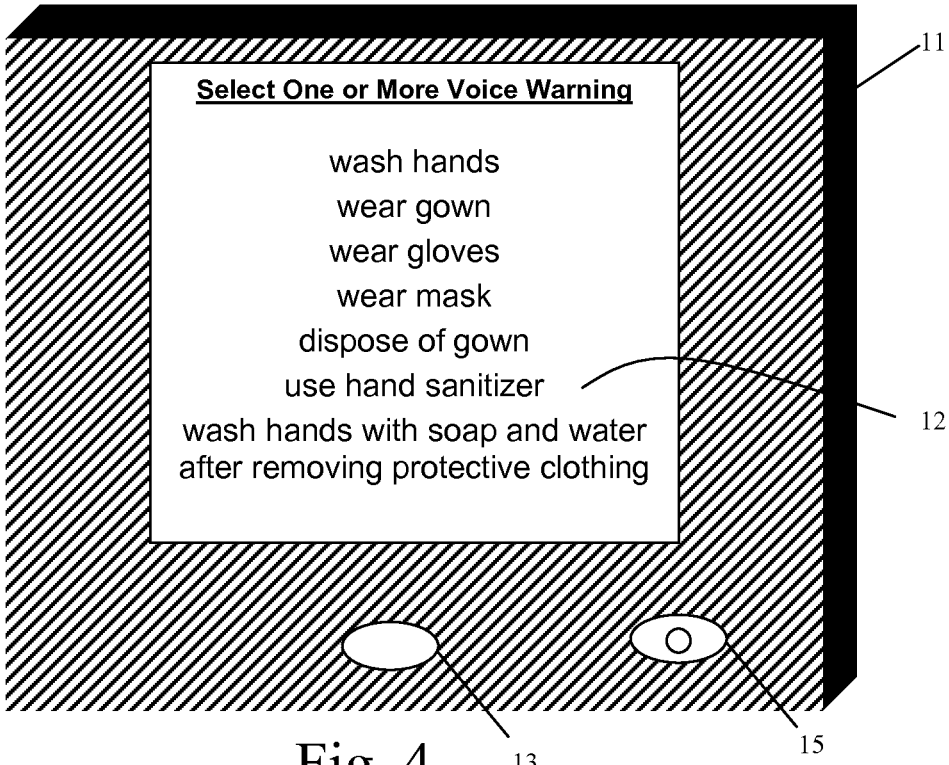
FIG. 4 is a front perspective view of a device according to the invention, showing a touch screen displaying a selectable list of voice warnings, and a speaker.

FIG. 4 illustrates the device of claim 1 as the display would appear when Select by Voice Warning is touched on the welcome screen.

Table 1 lists a more comprehensive list of possible voice warnings which can be preprogrammed in certain other embodiments of the invention.

TABLE 1

| List of Voice Warnings |
|---|
| Wash hands before entering |
| Wash hands before contact |
| Wash hands before putting on gloves |
| Wash hands after contact |
| Wash hands before and after contact |
| Wash hands after removing gloves |
| Wash hands after leaving the room |
| Wash hands with soap and water |

TABLE 1-continued

| List of Voice Warnings |
|---|
| Wash hands with soap and water after removing gloves |
| The use of gowns, gloves and eye protection is based on the task to be performed and the risk of exposure to blood and/or body fluids |
| Gowns, gloves and mask are to be worn for all patient contact and to be donned before entering the room |
| Gowns and gloves are required for all entering |
| Gowns and gloves are required for all patient contact |
| Gowns and gloves are required for all environmental contact |
| Dispose of gown in room |
| Dispose of gloves in room |
| Dispose of gown after leaving room |
| Do not enter this room unless you are immune to Chicken Pox |
| Do not enter unless you are immune to Rubella also known as German Measles |
| Do not enter this room unless you are immune to Rubeola |
| See nurse before entering this room |
| Susceptible persons may not enter this room |
| This is a negative pressure room |
| Keep door closed |
| Wear eye protection if splashing is likely |
| Wear mask |
| Wear mask if within 3 feet of patient |
| Wear N-95 mask or powered air respirator |
| Wear fitted TB mask or powered air respirator |
| Surgical masks and gloves required for all entering |
| Wear gown if contact with secretions possible |
| Do not enter if you have an active infection such as a sore throat, fever, diarrhea etc., |
| No children under 14 allowed |
| No fresh flowers or plants permitted |
| Wear gown if contamination of visitor or caregiver is anticipated |
| Use dedicated patient equipment |
| Do not enter, see nurse |

In Table 2, an example is shown of a set of simulated voice warning announcements which are automatically made by the device when certain medical conditions are selected by the nurse or other professional staff and the motion detector detects a person entering the room.

TABLE 2

Voice Warnings By Medical Condition

| Medical Condition | Synthetic Voice Warning |
|---|---|
| MRSA | Gowns and gloves are required for all entering, wash hands before and after contact, wash hands after removing gloves, dispose of gown and gloves in room, wear eye protection if splashing is likely, use dedicated patient equipment |
| C. diff | Gowns and gloves are required for all entering, wash hands before and after contact, wash hands with soap and water after removing gloves, dispose of gown and gloves in room, wear eye protection if splashing is likely, use dedicated patient equipment |
| Vancomycin-resistant *Enterococcus* | Gowns and gloves are required for all entering, wash hands before and after contact, wash hands after removing gloves, dispose of gown and gloves in room, wear eye protection if splashing is likely |
| *Klebsiella* pneumonia | Gowns and gloves for all entering, wash hands before and after contact, wash hands after removing gloves, dispose of gown and gloves in room, wear eye protection if splashing is likely, use dedicated patient equipment |
| H1N1 Influenza | Wear mask if within 3 feet of patient, wear N-95 mask or powered air respirator, gowns and gloves are required for all entering |
| Tuberculosis | This is a negative pressure room, wash hands before entering the room and after removing gloves, wear fitted TB mask or powered air respirator, wear gloves if contact possible with blood or body fluids, gowns are required if contamination of clothing is possible either by blood or body fluids or a contaminated environment, keep door closed. |
| Shingles, Zoster | Gowns and gloves for all entering, wash hands before and after contact, wash hands after removing gloves, dispose of gown and gloves in room, wear eye protection if splashing is likely, do not enter this room unless you are immune to Chicken Pox |

Upon selection of a medical condition, e.g., *C. diff.*, the system automatically determines the selection of appropriate voice warnings but would not announce or display the disease or medical condition, e.g., *C. diff.*, due to privacy concerns.

In some embodiments an authorized user such as a nurse has an option to select a type of isolation, in which case the preprogrammed voice warning corresponding to that type of isolation are emitted by the device upon detection of a person entering the room of the patient. Table 3 lists some examples of possible voice warnings corresponding to such types of isolation.

TABLE 3

Voice Warnings by Type of Isolation

| Type of Isolation | Voice Warning |
|---|---|
| Standard Precautions | wash hands before and after contact; the use of gowns, gloves and eye protection is based on the task to be performed and the risk of exposure to blood and/or body fluids. |
| Contact Precautions | Wear gowns, wear gloves, wash hands before and after removing gloves, wear mask if splashing of body fluids is possible |
| Airborne Precautions | This is a negative pressure room, wash hands before entering the room and after removing gloves, wear mask, wear gloves if contact possible with blood or body fluids, gowns are required if contamination of clothing is possible either by blood or body fluids or a contaminated environment, keep door closed. |
| Droplet Precautions | Surgical masks and gloves required for all entering, keep door closed, wear gown if contact with secretions possible, wash hands before and after patient contact, keep door closed. |
| Neutropenic Precautions | Do not enter if you have an active infection such as a sore throat, fever, diarrhea etc., no children under 14 allowed, wear gloves, wash hands before and after contact, no fresh flowers or plants permitted, wear gown if contamination of visitor or care giver is anticipated |

The device of the invention can be self-contained or can be part of another device or system. The programming can take place at the device, for example by a nurse selecting warnings as one would select from a menu of options on a dishwasher, washing machine, or dryer, or can take place at a nursing console or even remotely by a hospital administrator who oversees many rooms. The set of instructions which constitute the programming can be in C++ or any of a variety of programming languages, and would normally be programmed into the processor. The simulated voice messages can be recorded by a person or can be synthesized from a dictionary of words or sounds.

A manual override can be provided which allows a nurse or other frequent (and educated) visitors to the room to suppress the voice warning on a one time or as needed basis if it becomes annoying.

The device can be temporarily placed on a door jamb, door, or wall at or near the entrance of a patient room in some embodiments. The device can also be permanently placed on or in a door jamb, door, or wall. The device will also include in most embodiments a motion detector 15 for detecting the approach of a visitor to the patient's room. The motion detector is preferably focused so that it has a narrow field of view, for example a 15 degree field of view, and can be a passive infrared (PIR) type set to detect a person at 10 to 15 feet, or a laser or IR beam sensor of conventional or specialized type. The device may be placed at a location and configured such that the motion detector would not activate the alarm if a person is passing by but not entering the room, or may include hardware and software to determine whether a person detected by the motion detector is the patient or a nurse for whom the warning is not necessary or is undesirable. The motion detector function of the device may be adjustable so that higher or lower sensitivity may selected so that the alarm functions when people are entering the room but not when they are passing by the room.

The device can be programmed to allow selection of one or more languages, for example in certain institutions both English and Spanish language announcements should be made whereas in other institutions announcements in both English and French or another commonly used language should be made.

The device can also include, in some embodiments, a touch pad and programming to request a password, and to indicate successful activation.

The device may also include a visual warning such as flashing lights or a flashing sign such as "contact isolation, see nurse" which will flash when a visitor is detected entering the room.

The device may include a selection option on a touchpad to toggle between "select voice warning message," "select disease or medical condition," and "select type of isolation: modes.

The system and method of the invention are well adapted to solve a serious problem in hospitals and other institutions where patients may have diseases which require special precautions on those entering the patient's room to protect those entering and the patient wherein the state of the art is to post a sign indicating the precautions to be taken, and wherein such signs are often unnoticed. This invention provides an easily and quickly programmable system which allows selection of a disease or condition or type of isolation by an authorized person, wherein the selection of disease is not announced to those entering the room and thus complying with privacy requirements, and wherein a voice announcement of precautions to take is calculated from the disease, medical condition, or type of isolation, and wherein such voice announcement is automatically made when the system detects a person entering the patient room.

Though the invention has been described with respect to a number of embodiments, many additional variations and modifications will immediately become apparent to those skilled in the art. It is therefore the intention that the appended claims be interpreted as broadly as possible in view of the prior art to include all such variations and modifications.

What is claimed is:

1. A system comprising a plurality of devices each located at the entry of each of a plurality of patient rooms at a hospital, each device comprising a processor, memory, a speaker or voice generator, and a set of programming instructions functioning to allow an authorized user to select a disease, medical condition, or type of isolation which corresponds to preprogrammed simulated voice warnings;

a room entry detector programmed to activate the simulated voice warnings, each of the devices configured so that when entry of the room where the device is located is detected, the one or more simulated voice warnings corresponding to the selected disease, medical condition, or type of isolation, is emitted by the device; and a nursing console in communication with the plurality of devices located at the entry of each of the plurality of patient rooms, the nursing console adapted to remotely select one or more simulated voice warnings to be emitted for each of the plurality of devices;

wherein the nursing console is configured to allow the authorized user to alternatively select a disease or medical condition or type of isolation from one or more menus, each selection corresponding to one or more of the preprogrammed simulated voice warnings.

2. The system of claim 1 wherein the simulated voice warnings are selected from "wash hands," "wear gown," "wear gloves," "wear mask," "dispose of gown," "wash hands after removing protective clothing," and combinations of said simulated voice warnings.

3. The system of claim 1 wherein one or more of the plurality of devices are each adapted to be temporarily placed outside one of the plurality of patient rooms on a door jamb, door, or wall at or near the entrance of the one of the plurality of patient rooms.

4. The system of claim 1 wherein the plurality of devices each further includes a touch pad and programming to request a password, display a plurality of selectable medical conditions, and to indicate successful activation.

5. The system of claim 1 wherein the plurality of devices each further includes a visual warning.

6. The system of claim 1 wherein the plurality of devices each further includes a motion detector module for determining when a person is entering the one of the plurality of patient rooms.

7. The system of claim 1 wherein the plurality of devices each further includes means to select one or more languages for the one or more simulated voice warnings.

8. A method of warning visitors and medical staff of patient conditions in patient rooms comprising using the system according to claim 1, placing one of the plurality of devices outside the entry of each of the plurality of patient rooms and selecting at the nursing console one or more simulated voice warnings to be emitted for each of the plurality of devices so that when a person is detected entering any of the plurality of patient rooms, one or a combination of the one or more simulated voice warnings is emitted by the voice generator or speaker in the one of the plurality of devices outside the entry of the one of the plurality of patient rooms into which the person is detected entering.

* * * * *